US010009989B2

(12) United States Patent
Fang et al.

(10) Patent No.: US 10,009,989 B2
(45) Date of Patent: Jun. 26, 2018

(54) ELECTRONIC BALLAST WITH POWER THERMAL CUTBACK

(75) Inventors: Yuhong Fang, Naperville, IL (US); Arun Ganesh, Aurora, IL (US); Guangyi Luo, Shanghai (CN)

(73) Assignee: PHILIPS LIGHTING HOLDING B.V., Eindhoven (NL)

( * ) Notice: Subject to any disclaimer, the term of this patent is extended or adjusted under 35 U.S.C. 154(b) by 580 days.

(21) Appl. No.: 13/513,654

(22) PCT Filed: Nov. 22, 2010

(86) PCT No.: PCT/IB2010/055335
§ 371 (c)(1),
(2), (4) Date: Jun. 14, 2012

(87) PCT Pub. No.: WO2011/073829
PCT Pub. Date: Jun. 23, 2011

(65) Prior Publication Data

US 2013/0175950 A1 Jul. 11, 2013

Related U.S. Application Data

(60) Provisional application No. 61/286,498, filed on Dec. 15, 2009.

(51) Int. Cl.
*H05B 41/36* (2006.01)
*H05B 41/298* (2006.01)

(52) U.S. Cl.
CPC ..... *H05B 41/2981* (2013.01)

(58) Field of Classification Search
CPC ..... H05B 41/2981; H05B 41/2882; H05B 41/2883; H05B 41/2887; H05B 41/2928
(Continued)

(56) References Cited

U.S. PATENT DOCUMENTS 3,427,818 A * 2/1969 Erickson ..... B60H 1/0075 62/140
3,560,849 A * 2/1971 Ryan ..... G01R 31/2817 165/253

(Continued)

FOREIGN PATENT DOCUMENTS

JP 2002223572 A2 8/2002
TW 200942084 10/2009
WO WO 2008014632 A1 * 2/2008 ..... H05B 41/298

OTHER PUBLICATIONS

Anonymous: "Electronic Dimming Ballast Controller", Datasheet Catalog, Micro Linear ML4833 Datasheet, Jul. 2000, pp. 1-13, San Jose, CA, USA, XP002629112.

(Continued)

*Primary Examiner* — Jessica Han
*Assistant Examiner* — Jae Kim
(74) *Attorney, Agent, or Firm* — Akarsh P. Belagodu

(57) ABSTRACT

An electronic ballast with power thermal cutback including an electronic ballast operably connected to provide power to a lamp, the electronic ballast having a PFC converter (HO) operable to receive a PFC input voltage (112) and operable to provide a DC bus voltage on a DC bus (114); a DC/AC converter (120) operable to receive the DC bus voltage from the DC bus (114) and to provide AC power (122) to the lamp (140) at an AC output frequency; a compensator (130) responsive to an electronic ballast condition parameter, the compensator (130) being operable to provide a compensator signal to at least one of the PFC converter (110) and the DC/AC converter (120). At least one of the PFC converter (110) and the DC/AC converter (120) is responsive to the compensator signal to reduce the power to the lamp (140) when the electronic ballast condition parameter passes a threshold.

20 Claims, 12 Drawing Sheets

(58) Field of Classification Search
USPC ..... 315/309
See application file for complete search history.

(56) References Cited

U.S. PATENT DOCUMENTS

| | | | | |
|---|---|---|---|---|
| 5,384,516 | A | 1/1995 | Kawabata et al. | |
| 5,699,238 | A | 12/1997 | Lee et al. | |
| 6,072,283 | A * | 6/2000 | Hedrei | H05B 41/2882 315/209 R |
| 6,211,623 | B1 | 4/2001 | Wilhelm et al. | |
| 6,274,987 | B1 | 8/2001 | Burke | |
| 2006/0006816 | A1* | 1/2006 | Alexandrov | H02M 7/538 315/291 |
| 2006/0006818 | A1 | 1/2006 | Fishbein et al. | |
| 2007/0040516 | A1 | 2/2007 | Chen | |
| 2008/0054824 | A1* | 3/2008 | Ribarich | H05B 41/28 315/291 |
| 2009/0058302 | A1* | 3/2009 | Nerone | H05B 41/2827 315/70 |

OTHER PUBLICATIONS

Anonymous: "A 0-10VDC Contrtollable Ballast Using the ML4833", Fairchild Semiconductor Application Note 42036, Oct. 25, 2000, pp. 1-9, XP002629111.

* cited by examiner

ELECTRONIC BALLAST WITH POWER THERMAL CUTBACK

The technical field of this disclosure is power supplies, particularly, an electronic ballast with power thermal cutback.

Electronic ballasts can be used to provide high frequency AC power to light fluorescent lamps. Electronic ballasts commonly perform a number of power-related functions including, inter alia, the conversion of power from the primary sources to AC voltages and frequencies corresponding to the requirements of respective lamps, and the limiting and control of the flow of electrical current to the lamps.

Electronic ballasts can be subject to high temperatures in some applications, which can damage electronic ballast components and cause them to fail. Lamp fixtures using a number of high wattage lamps, such as a four lamp fixture employing 54 Watt lamps, are particularly likely to be subject to high temperatures. One approach to the problem of high temperatures has been to disregard the overheating, and repair or replace the electronic ballast when it failed. Another approach to the problem has been to shut down the electronic ballast when high temperature is detected, then repair or replace the electronic ballast. Unfortunately, both of these solutions leave the lamp off until the repair or replacement is made. This reduces the reliability of the lighting system and can require immediate repair if the lighting is critical, resulting in increased maintenance costs.

It would be desirable to have an electronic ballast with power thermal cutback that would overcome the above disadvantages.

Generally, in one aspect, the present invention focuses on an electronic ballast operably connected to provide power to a lamp, the electronic ballast having a PFC converter operable to receive a PFC input voltage and operable to provide a DC bus voltage on a DC bus; a DC/AC converter operable to receive the DC bus voltage from the DC bus and to provide AC power to the lamp at an AC output frequency; a compensator responsive to an electronic ballast condition parameter, the compensator being operable to provide a compensator signal to at least one of the PFC converter and the DC/AC converter. At least one of the PFC converter and the DC/AC converter is responsive to the compensator signal to reduce the power to the lamp when the electronic ballast condition parameter passes an electronic ballast condition parameter threshold.

Also, in another aspect, the present invention focuses on an electronic ballast operably connected to provide power to a lamp, the electronic ballast including a PFC converter operable to receive a PFC input voltage and operable to provide a DC bus voltage on a DC bus, the PFC converter being responsive to a DC bus adjust signal to adjust the DC bus voltage; a DC/AC converter operable to receive the DC bus voltage and to provide AC power to the lamp at an AC output frequency, the DC/AC converter being responsive to an output adjust signal to adjust the AC output frequency; a microcontroller responsive to the PFC input voltage to direct the DC bus adjust signal to reduce the DC bus voltage when the PFC input voltage is less than a threshold PFC input voltage, the microcontroller being further responsive to an electronic ballast temperature signal to direct the DC bus adjust signal to reduce the DC bus voltage when electronic ballast temperature is greater than a first threshold electronic ballast temperature, the microcontroller being further responsive to the electronic ballast temperature signal to direct the output adjust signal to increase the AC output frequency when the electronic ballast temperature is greater than a second threshold electronic ballast temperature.

Yet another aspect of the present invention contemplates a method of power thermal cutback including determining whether electronic ballast temperature is greater than a first threshold electronic ballast temperature; and reducing DC bus voltage when the electronic ballast temperature is greater than a first threshold electronic ballast temperature.

The foregoing and other features and advantages of the invention will become further apparent from the following detailed description of the presently preferred embodiments, read in conjunction with the accompanying drawings. The detailed description and drawings are merely illustrative of the invention, rather than limiting the scope of the invention being defined by the appended claims and equivalents thereof. In the drawings, like reference characters generally refer to the same parts throughout the different views. Also, the drawings are not necessarily to scale, emphasis instead generally being placed upon illustrating the principles of the invention.

In the following detailed description, for purposes of explanation and not limitation, representative embodiments disclosing specific details are set forth in order to provide a thorough understanding of the claimed invention. However, it will be apparent to one having ordinary skill in the art having had the benefit of the present disclosure that other embodiments according to the present teachings that depart from the specific details disclosed herein remain within the scope of the appended claims. Moreover, descriptions of well-known apparatuses and methods may be omitted so as to not obscure the description of the representative embodiments. Such methods and apparatuses are clearly within the scope of the claimed invention.

Figure 1:
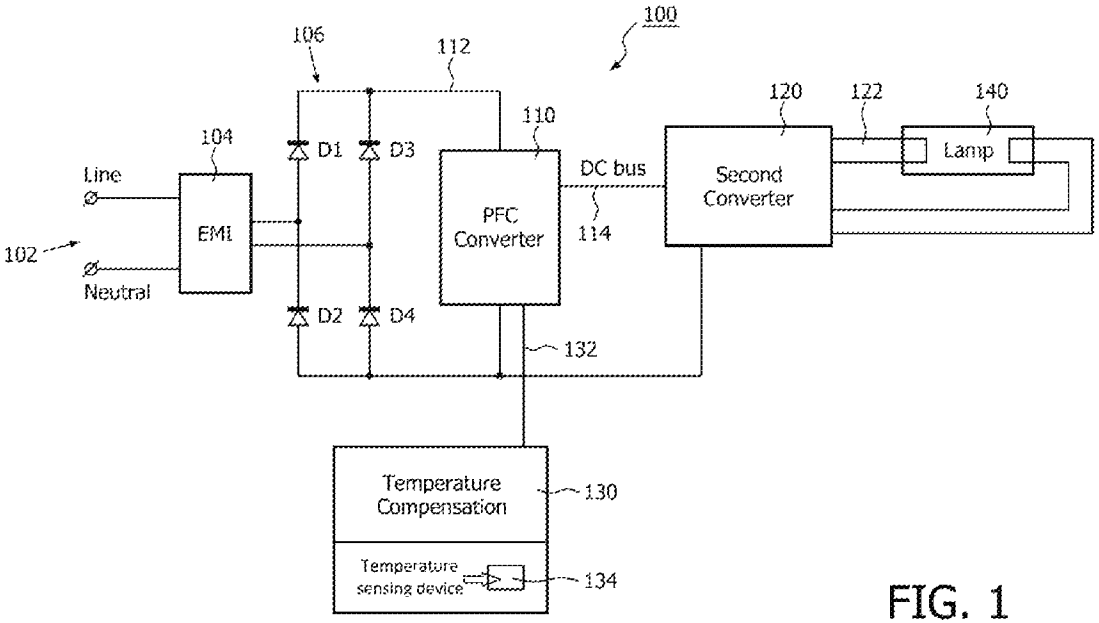
FIG. 1 is a block diagram of an electronic ballast in accordance with the present invention.

FIG. 1 is a block diagram of an electronic ballast in accordance with one exemplary embodiment of the present invention. The electronic ballast is operably connected to provide power to a lamp and includes a PFC converter, a DC/AC converter, and a compensator. The PFC converter is operable to receive a PFC input voltage, such as a rectified AC voltage, and operable to provide a DC bus voltage on a DC bus. The DC/AC converter is operable to receive the DC bus voltage from the DC bus and to provide AC power to the lamp at an AC output frequency. The compensator is responsive to an electronic ballast condition parameter and is operable to provide a compensator signal to at least one of the PFC converter and the DC/AC converter. At least one of the PFC converter and the DC/AC converter is responsive to the compensator signal to reduce the power to the lamp when the electronic ballast condition parameter passes an electronic ballast condition parameter threshold. The electronic ballast condition parameter is defined herein as one of electronic ballast temperature, PFC input voltage, or a combination of the electronic ballast temperature and PFC input voltage. In this embodiment, the electronic ballast condition parameter is the electronic ballast temperature, and the PFC converter is responsive to the compensator signal to reduce the DC bus voltage on the DC bus when the electronic ballast temperature is greater than a threshold electronic ballast temperature to reduce the power to the lamp.

The electronic ballast 100 includes a PFC converter 110, a DC/AC converter 120, and a compensator 130. The PFC converter 110, which can be a boost converter, receives the PFC input voltage 112, such as a rectified AC voltage, and provides the DC bus voltage on the DC bus 114. The DC/AC converter 120, which can be a controller driven converter in a program start ballast or a self oscillation converter in an instant start ballast, receives the DC bus voltage from the DC bus 114 and provides AC power 122 to the lamp 140 at the AC output frequency. For fixed light output electronic ballasts, the output AC power 122 to the lamp 140 can be proportional to the DC bus voltage of the DC bus 114 for both controller driven converters and self oscillation converters. The compensator 130 is responsive to an electronic ballast condition parameter and provides a DC bus adjust signal 132 as compensator signal. In this embodiment, the electronic ballast condition parameter is electronic ballast temperature and the PFC converter 110 is responsive to the DC bus adjust signal 132 to reduce the DC bus voltage on the DC bus 114 when the electronic ballast temperature is greater than a threshold electronic ballast temperature, reducing power to the lamp 140. In this example, the PFC input voltage 112 is provided from mains voltage 102 passing through electromagnetic interference (EMI) filter 104 and full wave rectifier 106. The PFC input voltage 112 can be sensed to indicate the magnitude of the mains voltage 102.

The compensator 130 includes a temperature sensing device 134, such as negative temperature coefficient (NTC) thermal resistor. The DC bus voltage on the DC bus 114 is adjusted automatically in response to the measured electronic ballast temperature. When the electronic ballast temperature exceeds the threshold electronic ballast temperature, the DC bus voltage on the DC bus 114 is decreased, decreasing the output AC power 122 of the electronic ballast 100. The power thermal cutback protects the electronic ballast 100 from high temperature that can occur in certain applications, while keeping the lamp 140 on at a reduced light output.

Figure 2:
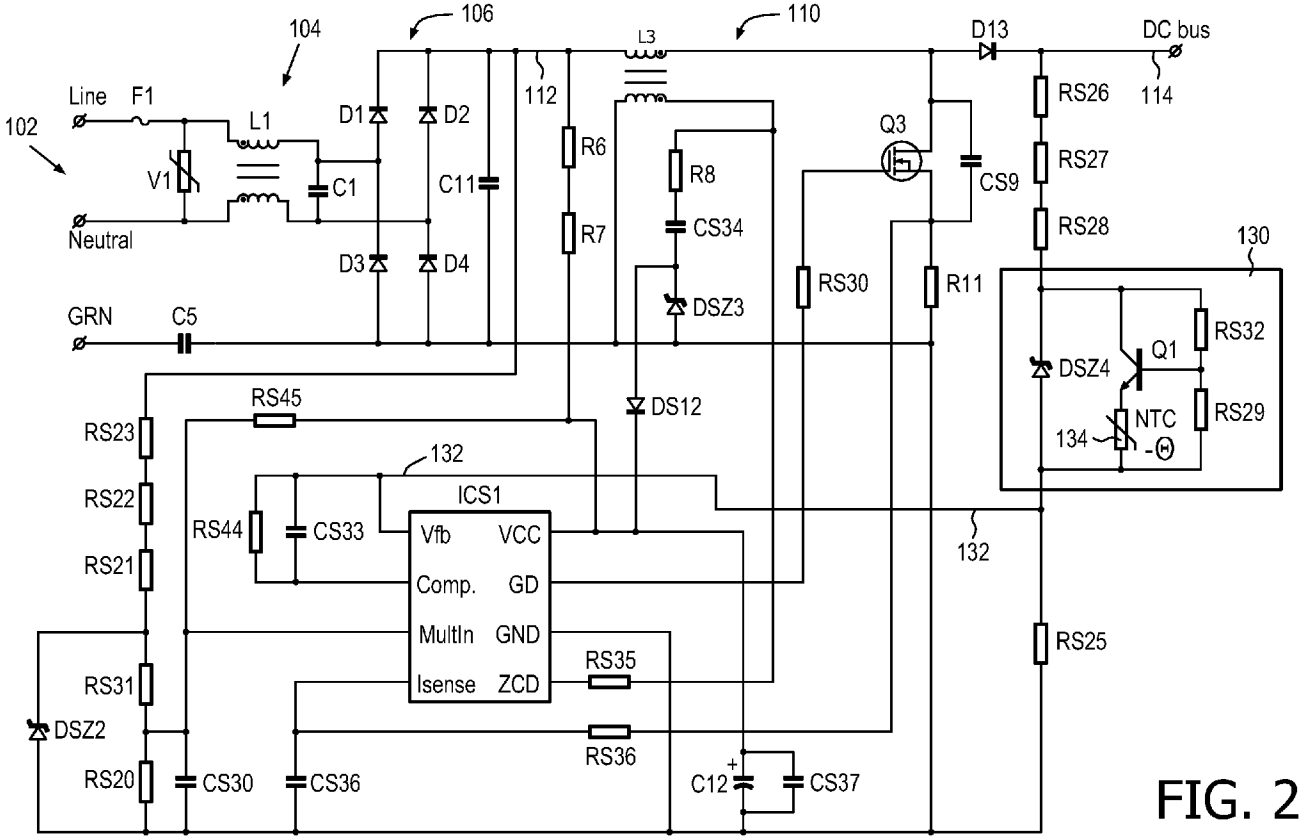
FIG. 2 is a schematic diagram of an electronic ballast in accordance with an embodiment of the present invention.

Referring now to FIG. 2, in which like elements share like reference numbers with FIG. 1, is a schematic diagram of an electronic ballast is shown. The compensator 130 includes an NTC thermal resistor as the temperature sensing device.

The converter 130 in this example includes a Zener diode DSZ4; a voltage divider having a first resistor RS32 and a second resistor RS29; and a transistor circuit having a transistor Q1 operably connected in series with a negative temperature coefficient thermal resistor NTC, the transistor Q1 having an emitter operably connected to the negative temperature coefficient thermal resistor NTC and a base operably connected between the first resistor RS32 and the second resistor RS29. The Zener diode DSZ4, the voltage divider, and the transistor circuit are operably connected in parallel between a third resistor (RS26, RS27, RS28 in series) operably connected to the DC bus and a fourth resistor RS25 operably connected to common.

The PFC converter 110 includes a boost converter consisting of switch Q3, inductor L3, and diode D13, with critical conduction mode PFC controller ICS1. The pin Vfb of PFC controller ICS1 is a feedback input which has reference voltage $V_{ref}$ of 2.5V. The compensator 130, which is a temperature compensation circuit, includes Zener diode DSZ4, transistor Q1, NTC thermal resistor NTC, and resistors RS32, RS29. $I_{ref}$ is the current in RS25, which is $V_{ref}$/RS25. The equivalent resistance $R_{equi}$ of the converter 130 is about $R_{NTC}\times$(RS32+RS29)/RS29. In normal operation below the threshold electronic ballast temperature, the equivalent resistance $R_{equi}$ is high, so that $I_{ref}\times R_{equi}>V_{DSZ4}$. Therefore, the DC bus voltage is determined by the Zener voltage of DSZ4 to be $V_{bus}=I_{ref}\times$(RS26+RS27+RS28)+$V_{DSZ4}+V_{ref}$. The resistance of NTC decreases with increasing electronic ballast temperature. In abnormal operation above the threshold electronic ballast temperature, the equivalent resistance $R_{equi}$ is low, so that $I_{ref}\times R_{equi}<V_{DSZ4}$. Therefore, the DC bus voltage is determined by the $R_{equi}$ to be $V_{bus}=I_{ref}\times$(RS26+RS27+RS28+$R_{equi}$)+$V_{ref}$. As the electronic ballast temperature increases in the temperature region above the threshold electronic ballast temperature, the resistance of NTC decreases, decreasing equivalent resistance $R_{equi}$, and decreasing DC bus voltage $V_{bus}$.

Figure 3:
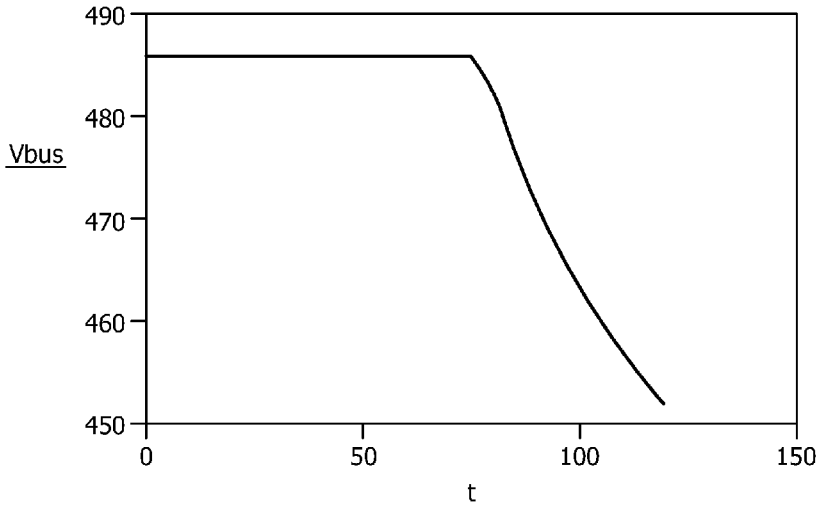
FIG. 3 is a graph of DC bus voltage versus electronic ballast temperature as calculated for an electronic ballast in accordance with an embodiment of the present invention.

FIG. 3 is a graph of DC bus voltage versus electronic ballast temperature as calculated for an electronic ballast in accordance with various embodiments of the present invention. In this example, for the embodiment shown in FIG. 2, the calculated values for DC bus voltage as a function of electronic ballast temperature are constant at about 487 Volts until the electronic ballast temperature exceeds the threshold electronic ballast temperature of about 80 degrees Celsius. The DC bus voltage declines with increasing temperature above the threshold electronic ballast temperature from about 487 Volts at about 80 degrees Celsius to about 452 Volts at about 120 degrees Celsius. Those skilled in the art will appreciate that the components can be selected as desired for a particular application, so that the threshold electronic ballast temperature occurs at a desired temperature and/or the DC bus voltage declines at a desired rate.

Figure 4:
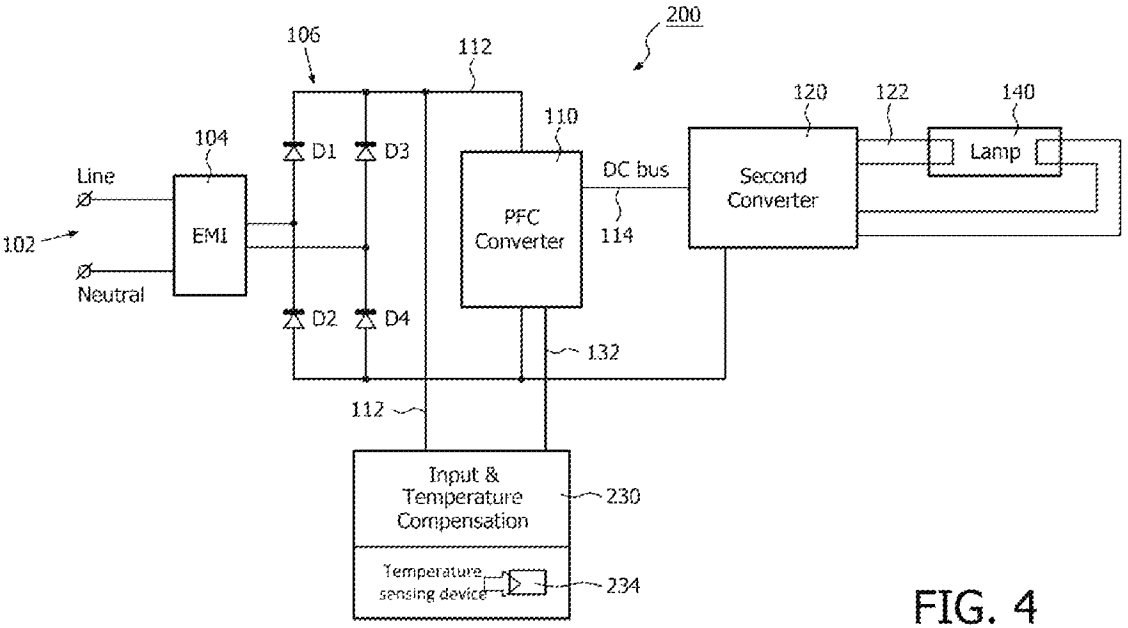
FIG. 4 is a block diagram of another embodiment of an electronic ballast in accordance with an embodiment of the present invention.

FIG. 4, in which like elements share like reference numbers with FIG. 1, is a block diagram of another embodiment of an electronic ballast in accordance with the present invention. In this embodiment, the electronic ballast condition parameter is a combination of the electronic ballast temperature and PFC input voltage, and the PFC converter is responsive to the compensator signal to reduce the DC bus voltage on the DC bus to reduce the power to the lamp when the electronic ballast temperature is greater than a threshold electronic ballast temperature or the PFC input voltage is less than a threshold PFC input voltage.

The electronic ballast 200 includes a PFC converter 110, a DC/AC converter 120, and a compensator 230. The compensator 230 is responsive to an electronic ballast condition parameter and provides a DC bus adjust signal 132 as compensator signal. In this embodiment, the electronic ballast condition parameter is a combination of the electronic ballast temperature and PFC input voltage. The PFC converter 110 is responsive to the DC bus adjust signal 132 to reduce the DC bus voltage on the DC bus 114, reducing power to the lamp 140, when the electronic ballast temperature is greater than a threshold electronic ballast temperature and/or the PFC input voltage is less than a threshold PFC input voltage.

The compensator 230 includes a temperature sensing device 234, such as negative temperature coefficient (NTC) thermal resistor. The compensator 230 is also responsive to PFC input voltage 112. The DC bus voltage on the DC bus 114 is adjusted automatically in response to the measured electronic ballast temperature and/or the measured PFC input voltage. When the electronic ballast temperature exceeds the threshold electronic ballast temperature and/or the PFC input voltage is less than the threshold PFC input voltage, the DC bus voltage on the DC bus 114 is decreased, decreasing the output AC power 122 of the electronic ballast 200.

The PFC input voltage is an electronic ballast condition parameter because high temperature operation can occur below a threshold PFC input voltage, i.e., when the PFC input voltage is low: high input current is needed to maintain a high DC bus voltage at a low PFC input voltage corresponding to a low input voltage, resulting in high temperatures. The DC bus voltage on the DC bus 114 is usually set slightly higher than the peak voltage of the maximum mains voltage 102. For the example of an electronic ballast with a universal input voltage, the maximum input mains voltage is 305 Volts rms, so the peak voltage is 431 Volts (from 305 Volts rms×1.414). The minimum DC bus voltage on the DC bus 114 would be 450 Volts to avoid an undesirable power factor and total harmonic distortion (THD). When the DC bus voltage on the DC bus 114 is set at 480 Volts, the adjustable range of the DC bus voltage is only 450 to 480 Volts which is very narrow (30 Volts or 6.25 percent).

The DC bus voltage can be set at a lower voltage for a lower mains voltage 102. A lower DC bus voltage reduces input current, reducing the chance of overheating the electronic ballast. In this example, the DC bus voltage is decreased when the PFC input voltage 112 indicative of the mains voltage 102 is less than a threshold PFC input voltage. Those skilled in the art will appreciate that the value for the DC bus voltage can be limited by operating considerations, such as power factor and total harmonic distortion (THD), limiting the amount by which the DC bus voltage can be decreased. For example, the DC bus voltage is typically maintained above a value of the maximum input mains voltage (rms) times 1.414. In one embodiment, the electronic ballast limits the decrease in the DC bus voltage so the resulting DC bus voltage is greater than the maximum input mains voltage (rms) times 1.414, or alternatively, an operating margin allowance plus the maximum input mains voltage (rms) times 1.414. The power thermal cutback protects the electronic ballast 200 from high temperature that can occur in certain applications, while keeping the lamp 140 on at a reduced light output.

Figure 5:
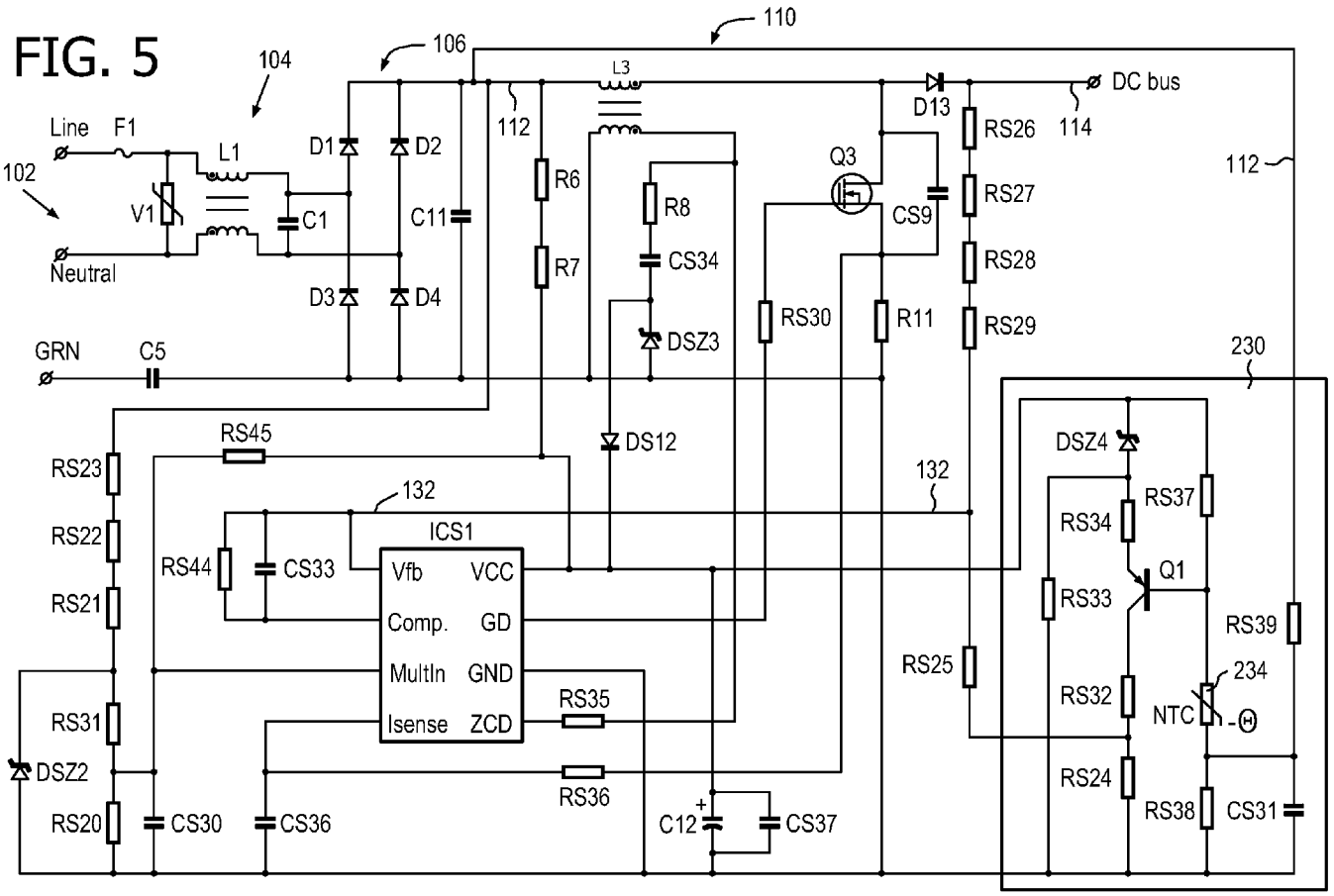
FIG. 5 is a schematic diagram of an electronic ballast in accordance with an embodiment of the present invention.

FIG. 5, in which like elements share like reference numbers with FIG. 4, is a schematic diagram of an electronic ballast in accordance with the present invention. The compensator 230 includes an NTC thermal resistor as the temperature sensing device and is responsive to the PFC input voltage indicative of the mains voltage.

The compensator 230 in this example includes a Zener diode circuit having a Zener diode DSZ4, a first resistor RS34, a transistor Q1, a second resistor RS32, and a third resistor RS24 connected in series; and a resistor circuit having a fourth resistor RS37, a negative temperature compensation resistor NTC, and a fifth resistor RS38 connected in series. The transistor Q1 has a base operably connected between the fourth resistor RS37 and the negative temperature coefficient thermal resistor NTC; the PFC input voltage is operably connected through a sixth resistor RS39 to a junction between the negative temperature coefficient thermal resistor NTC and the fifth resistor RS38; the DC bus adjust signal is present between the second resistor RS32 and the third resistor RS24; and the Zener diode circuit and the resistor circuit are connected in parallel between a fixed voltage $V_{cc}$ and common.

The PFC converter 110 includes a boost converter consisting of switch Q3, inductor L3, and diode D13, with critical conduction mode PFC controller ICS1. The pin Vfb of PFC controller ICS1 is a feedback input which has reference voltage $V_{ref}$ of 2.5V. The compensator 230, which is a temperature and input voltage compensation circuit, includes Zener diode DSZ4, transistor Q1, NTC thermal resistor NTC, capacitor CS31, and resistors RS24, RS32, RS33, RS34, RS37, RS38, RS39.

In normal operation without input from the compensator 230, the DC bus voltage is fixed. The collector current of Q1 is zero, i.e., there is no current contribution from Q1, so $I_{ref}=V_{ref}/(RS24+RS25)$. The DC bus voltage $V_{bus}=I_{ref}\times(RS26+RS27+RS28+RS29)+V_{ref}$, so the DC bus voltage is determined by the value of $V_{ref}$.

When the electronic ballast temperature exceeds the threshold electronic ballast temperature, such as a component temperature of 100 degrees Celsius, for example, the compensator 230 reduces the DC bus voltage. The resistance of NTC decreases with increasing electronic ballast temperature, so that the base voltage $V_b$ of Q1 decreases and the voltage across resistor RS37 ($V_{RS37}$) increases. When $V_{RS37}$ is greater than the sum of the Zener voltage of DZS4 ($V_{DSZ4}$) and the emitter-base voltage drop $V_{eb}$ of Q1, the transistor Q1 conducts with the collector current $I_c$ of Q1 determined by resistor RS34 and $V_{RS37}$. The transistor Q1 conducts when the electronic ballast temperature exceeds the threshold electronic ballast temperature. As the collector current $I_c$ of Q1 increases, the voltage across resistor RS24 ($V_{RS24}$) increases, the voltage across resistor RS25 ($V_{RS25}$) decreases, and the reference current $I_{ref}$ decreases. The PFC controller ICS1 reduces the DC bus voltage $V_{bus}$ in response to the decreased reference current $I_{ref}$.

When the PFC input voltage is less than a threshold PFC input voltage, the compensator 230 reduces the DC bus voltage. The PFC input voltage 112 is indicative of the mains voltage 102. As the PFC input voltage 112 decreases, the the base voltage $V_b$ of Q1 decreases and the voltage across resistor RS37 ($V_{RS37}$) increases. When $V_{RS37}$ is greater than the sum of the Zener voltage of DZS4 ($V_{DSZ4}$) and the emitter-base voltage drop $V_{eb}$ of Q1, the transistor Q1 conducts with the collector current $I_c$ of Q1 determined by resistor RS34 and $V_{RS37}$. Also, the transistor Q1 conducts when the PFC input voltage is less than a threshold PFC input voltage. As the collector current $I_c$ of Q1 increases, the voltage across resistor RS24 ($V_{RS24}$) increases, the voltage across resistor RS25 ($V_{RS25}$) decreases, and the reference current $I_{ref}$ decreases. The PFC controller ICS1 reduces the DC bus voltage $V_{bus}$ in response to the decreased reference current $I_{ref}$.

Those skilled in the art will appreciate that the embodiment illustrated in FIG. 5 can be easily modified so that the electronic ballast condition parameter is either the electronic ballast temperature or the PFC input voltage, rather than the combination of the electronic ballast temperature and the PFC input voltage. The voltage across the resistor RS39 can be fixed by connecting the high side of the resistor RS39 to a fixed voltage, rather than the PFC input voltage, to make the electronic ballast condition parameter the electronic ballast temperature alone. The NTC thermal resistor can be replaced with a fixed value resistor to make the electronic ballast condition parameter the PFC input voltage alone.

Figure 6:
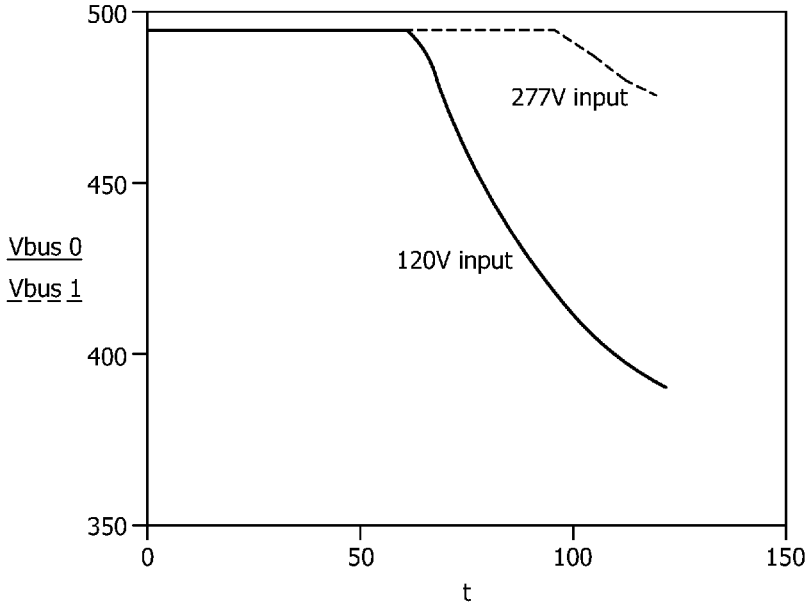
FIG. 6 is a graph of DC bus voltage versus temperature as calculated for an electronic ballast in accordance with an embodiment of the present invention.

FIG. 6 is a graph of DC bus voltage versus temperature as calculated for an electronic ballast in accordance with various embodiments of the present invention. FIG. 6 illustrates the change in DC bus voltage with the combination of electronic ballast temperature and PFC input voltage for the embodiment of FIG. 5.

Referring to FIG. 6, in this example for a mains input voltage of 277 Volts, the calculated values for DC bus voltage as a function of electronic ballast temperature are constant at about 497 Volts until the electronic ballast temperature exceeds the threshold electronic ballast temperature of about 95 degrees Celsius. The DC bus voltage declines with increasing temperature above the threshold electronic ballast temperature from about 497 Volts at about 95 degrees Celsius to about 480 Volts at about 120 degrees Celsius. In this example for a mains input voltage of 120 Volts, the calculated values for DC bus voltage as a function of electronic ballast temperature are constant at about 497 Volts until the electronic ballast temperature exceeds the threshold electronic ballast temperature of about 60 degrees Celsius. The DC bus voltage declines with increasing temperature above the threshold electronic ballast temperature from about 497 Volts at about 60 degrees Celsius to about 410 Volts at about 100 degrees Celsius.

FIG. 6 also illustrates the change in DC bus voltage with changing mains voltage, i.e., with changing PFC input voltage. At a constant electronic ballast temperature of 100 degrees Celsius, the DC bus voltage is changed from about 490 Volts to about 410 Volts when the mains voltage is changed from 277 Volts to 120 Volts.

Those skilled in the art will appreciate that the components can be selected as desired for a particular application, so that the threshold electronic ballast temperature occurs at a desired temperature, the threshold PFC input voltage occurs at a desired voltage, and/or the DC bus voltage declines at a desired rate.

Figure 7:
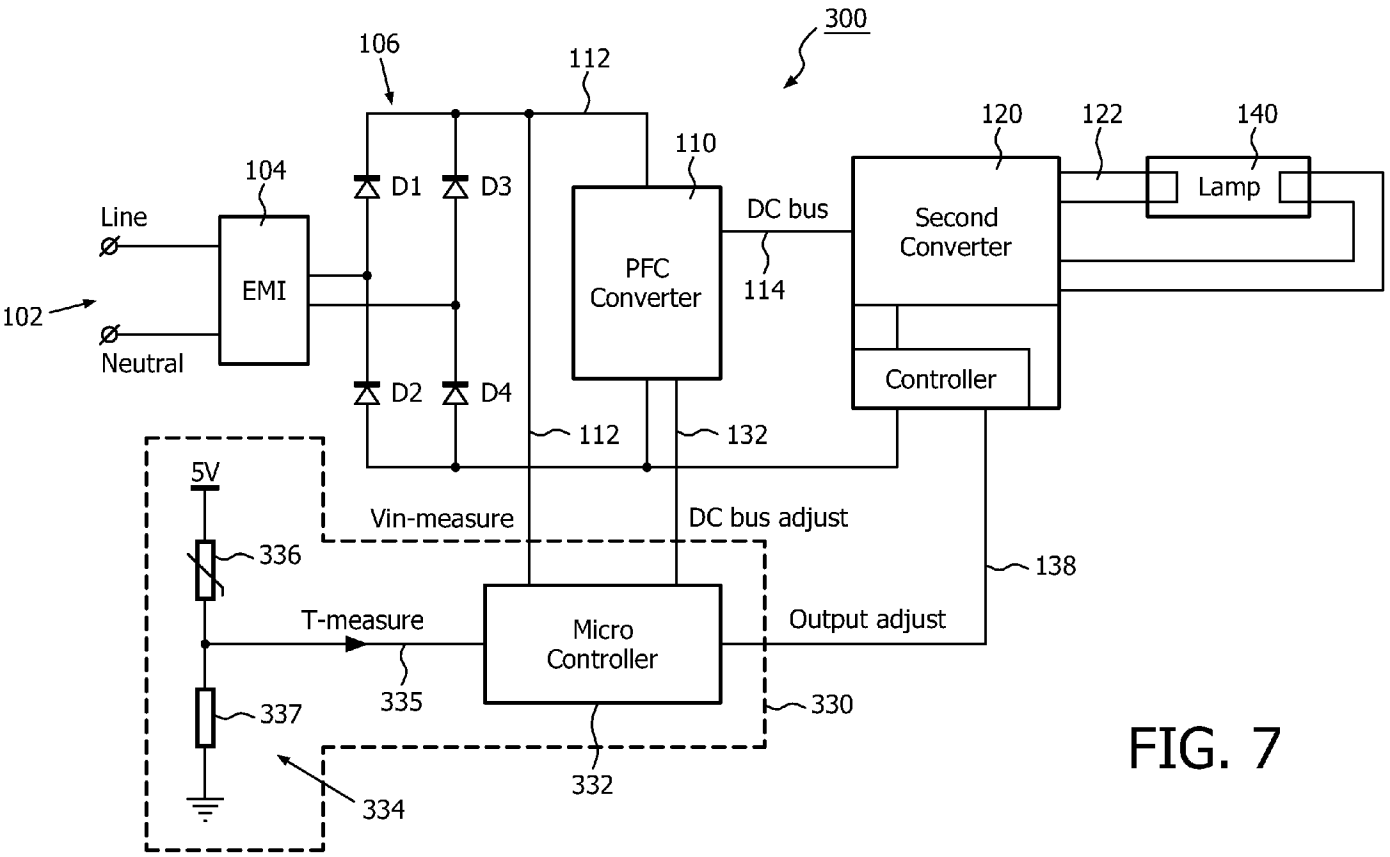
FIG. 7 is a block diagram of another embodiment of an electronic ballast in accordance with an embodiment of the present invention.

FIG. 7, in which like elements share like reference numbers with FIG. 4, is a block diagram of yet another embodiment of an electronic ballast in accordance with the present invention. In this embodiment, a microcontroller serves as the compensator, so the electronic ballast condition parameter can be electronic ballast temperature, PFC input voltage, or a combination of the electronic ballast temperature and PFC input voltage, depending on how the microcontroller is programmed.

The compensator 330 of the electronic ballast 300 includes a microcontroller 332 and a temperature sensing device 334. The microcontroller 332 is responsive to the PFC input voltage 112 and/or the electronic ballast temperature signal 335 from the temperature sensing device 334 to provide the DC bus adjust signal 132 to the PFC converter 110 and/or output adjust signal 138 to the DC/AC converter 120.

In this example, the temperature sensing device 334 is a series circuit of a negative temperature coefficient (NTC) thermal resistor 336 and fixed value resistor 337 operably connected between a fixed voltage and common. The electronic ballast temperature signal 335 is sensed between the NTC thermal resistor 336 and fixed value resistor 337. As temperature increases, the resistance of the NTC thermal resistor 336 decreases, increasing the electronic ballast temperature signal 335. Those skilled in the art will appreciate that the temperature sensing device 334 can be any circuit providing a temperature signal as a function of electronic ballast temperature, and can include thermocouples, NTC thermal resistors, positive temperature coefficient (PTC) thermal resistors, resistance temperature detectors, or like temperature sensing elements.

The operational sequence of the power thermal cutback for the electronic ballast can be programmed in the microcontroller 332 as desired for a particular application. In one embodiment, the microcontroller 332 sets the DC bus voltage on the DC bus 114 with the DC bus adjust signal 132 in response to the PFC input voltage 112, with the DC bus voltage set lower when the PFC input voltage 112 is less than a threshold PFC input voltage. When the electronic ballast temperature exceeds the threshold electronic ballast temperature, the microcontroller 332 adjusts DC bus adjust signal 132 to reduce the DC bus voltage on the DC bus 114 in response to the electronic ballast temperature signal 335. Those skilled in the art will appreciate that the value for the DC bus voltage can be limited by operating considerations, such as power factor and total harmonic distortion (THD), limiting the amount by which the DC bus voltage can be decreased. For example, the DC bus voltage is typically maintained above a value of the maximum input mains voltage (rms) times 1.414. In one embodiment, the microcontroller 332 limits the decrease in the DC bus voltage so the resulting DC bus voltage is greater than the maximum input mains voltage (rms) times 1.414, or alternatively, an operating margin allowance plus the maximum input mains voltage (rms) times 1.414.

When the electronic ballast temperature attained through DC bus voltage reduction is insufficient and the electronic ballast temperature remains high, the microcontroller 332 adjusts output adjust signal 138 to increase the AC output frequency of the output AC power 122 to the lamp 140 in response to the electronic ballast temperature signal 335. Those skilled in the art will appreciate that the microcontroller 332 can be programmed as desired for a particular application, so that the DC bus voltage is responsive to either, both, or neither of the electronic ballast temperature and the PFC input voltage, and the AC output frequency of the output AC power is or is not responsive to the electronic ballast temperature.

Figure 8:
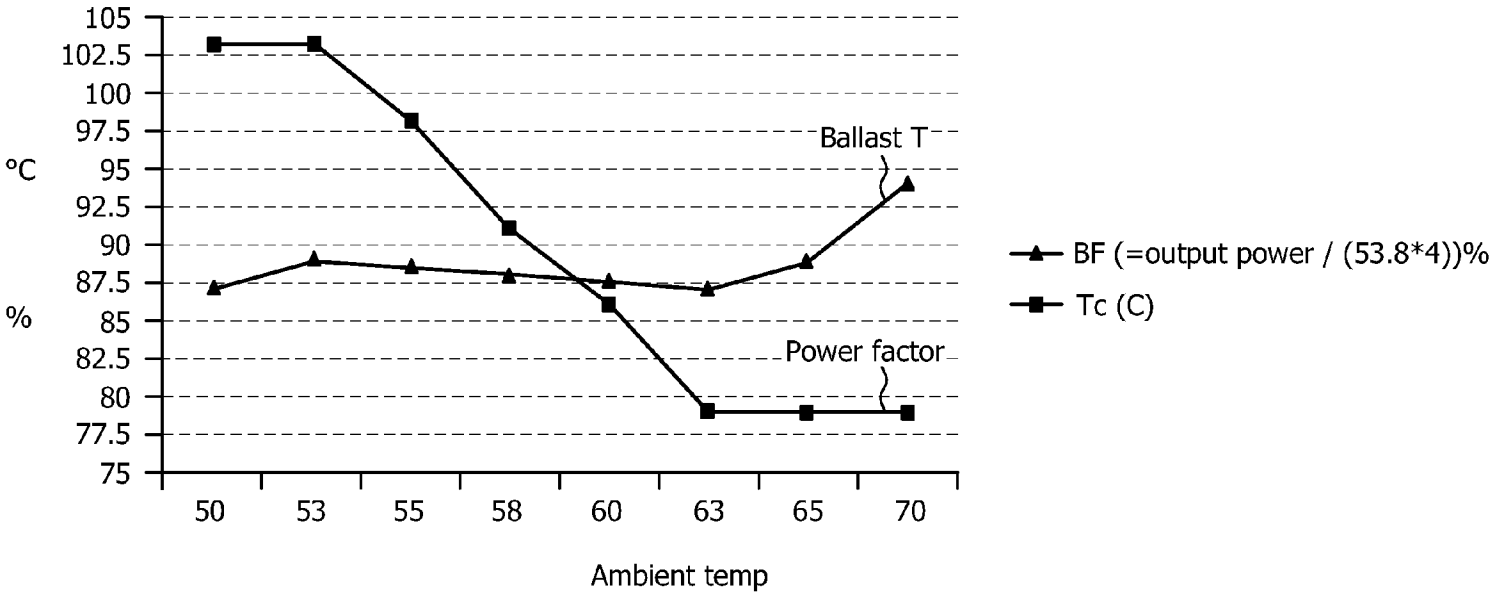
FIG. 8 is a graph of ballast factor and electronic ballast temperature versus ambient temperature as measured for an electronic ballast in accordance with an embodiment of the present invention.

FIG. 8 is a graph of ballast factor and electronic ballast temperature versus ambient temperature as measured for an electronic ballast in accordance with various embodiments of the present invention. The ballast factor is present output power divided by rated output power for the electronic ballast. In this example for the embodiment of FIG. 7, only the DC bus voltage is adjusted in response to electronic ballast temperature. When the electronic ballast temperature exceeds the threshold electronic ballast temperature of about 89 degrees Celsius at an ambient temperature of about 53 degrees Celsius, the DC bus voltage is reduced, so the power factor is decreased from about 103 percent at an ambient temperature of about 53 degrees Celsius to about 79 percent at an ambient temperature of about 63 degrees Celsius. The electronic ballast temperature remains approximately constant at about 88 degrees Celsius, in spite of the increase in ambient temperature from about 53 degrees Celsius to about 63 degrees Celsius.

Figure 9:
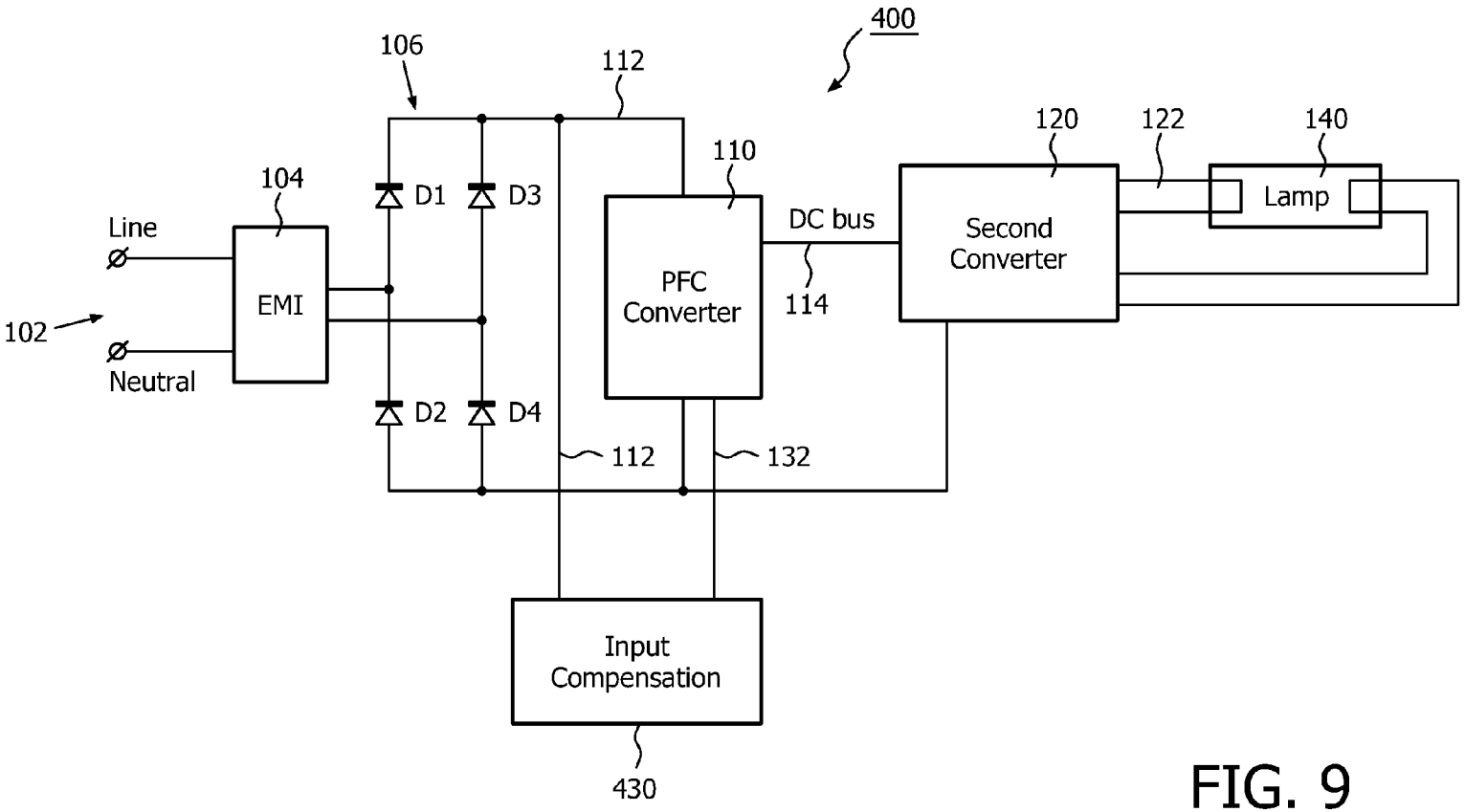
FIG. 9 is a block diagram of another embodiment of an electronic ballast in accordance with an embodiment of the present invention.

FIG. 9, in which like elements share like reference numbers with FIG. 4, is a block diagram of still another embodiment of an electronic ballast in accordance with the present invention. In this embodiment, the electronic ballast condition parameter is the PFC input voltage, and the PFC converter is responsive to the compensator signal to reduce the DC bus voltage on the DC bus to reduce the power to the lamp when the PFC input voltage is less than a threshold PFC input voltage.

The compensator 430 of electronic ballast 400 is responsive to the PFC input voltage 112 to provide the DC bus adjust signal 132 as compensator signal. The PFC converter 110 is responsive to the DC bus adjust signal 132 to reduce the DC bus voltage on the DC bus 114, reducing power to the lamp 140, when the PFC input voltage 112 is less than a threshold PFC input voltage. In one embodiment, the compensator 430 is the compensator 230 of FIG. 5, with the NTC thermal resistor replaced with a fixed value resistor.

Referring to FIG. 9, the PFC input voltage is an electronic ballast condition parameter because high temperature operation can occur below a threshold PFC input voltage: high input current is needed to maintain a high DC bus voltage at a low PFC input voltage corresponding to a low input voltage, resulting in high temperatures. The DC bus voltage on the DC bus 114 is usually set slightly higher than the peak voltage of the maximum mains voltage 102. For the example of an electronic ballast with a universal input voltage, the maximum input mains voltage is 305 Volts rms, so the peak voltage is 431 Volts (from 305 Volts rms×1.414). The minimum DC bus voltage on the DC bus 114 would be 450 Volts to avoid an undesirable power factor and total harmonic distortion (THD). When the DC bus voltage on the DC bus 114 is set at 480 Volts, the adjustable range of the DC bus voltage is only 450 to 480 Volts which is very narrow (30 Volts or 6.25 percent).

The DC bus voltage can be set at a lower voltage for a lower mains voltage 102. A lower DC bus voltage reduces input current, reducing the chance of overheating the electronic ballast. In this example, the DC bus voltage is decreased when the PFC input voltage 112 indicative of the mains voltage 102 is less than a threshold PFC input voltage. The power thermal cutback protects the electronic ballast 400 from high temperature that can occur in certain applications, while keeping the lamp 140 on at a reduced light output.

Figure 10:
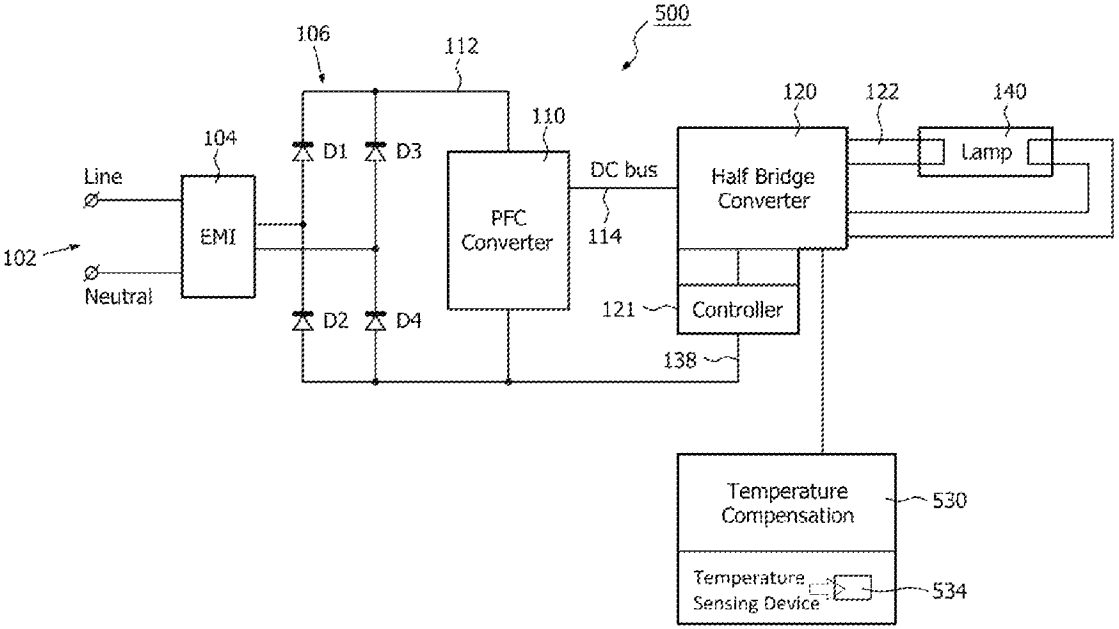
FIG. 10 is a block diagram of another embodiment of an electronic ballast in accordance with an embodiment of the present invention.

FIG. 10, in which like elements share like reference numbers with FIG. 1, is a block diagram of yet another embodiment of an electronic ballast in accordance with the present invention. In this embodiment, the electronic ballast condition parameter is the electronic ballast temperature, and the DC/AC converter is responsive to the compensator signal to increase the AC output frequency to reduce the power to the lamp when the electronic ballast temperature is greater than a threshold electronic ballast temperature.

The compensator 530 of electronic ballast 500 is responsive to an electronic ballast condition parameter and provides an output adjust signal 138, which is the compensator signal. In this embodiment, the electronic ballast condition parameter is the electronic ballast temperature. The compensator 530 includes a temperature sensing device 534 to monitor the electronic ballast temperature. The DC/AC converter 120 is responsive to the output adjust signal 138 to increase the AC output frequency of the AC power 122, reducing power to the lamp 140, when the electronic ballast temperature is greater than a threshold electronic ballast temperature.

Figure 11:
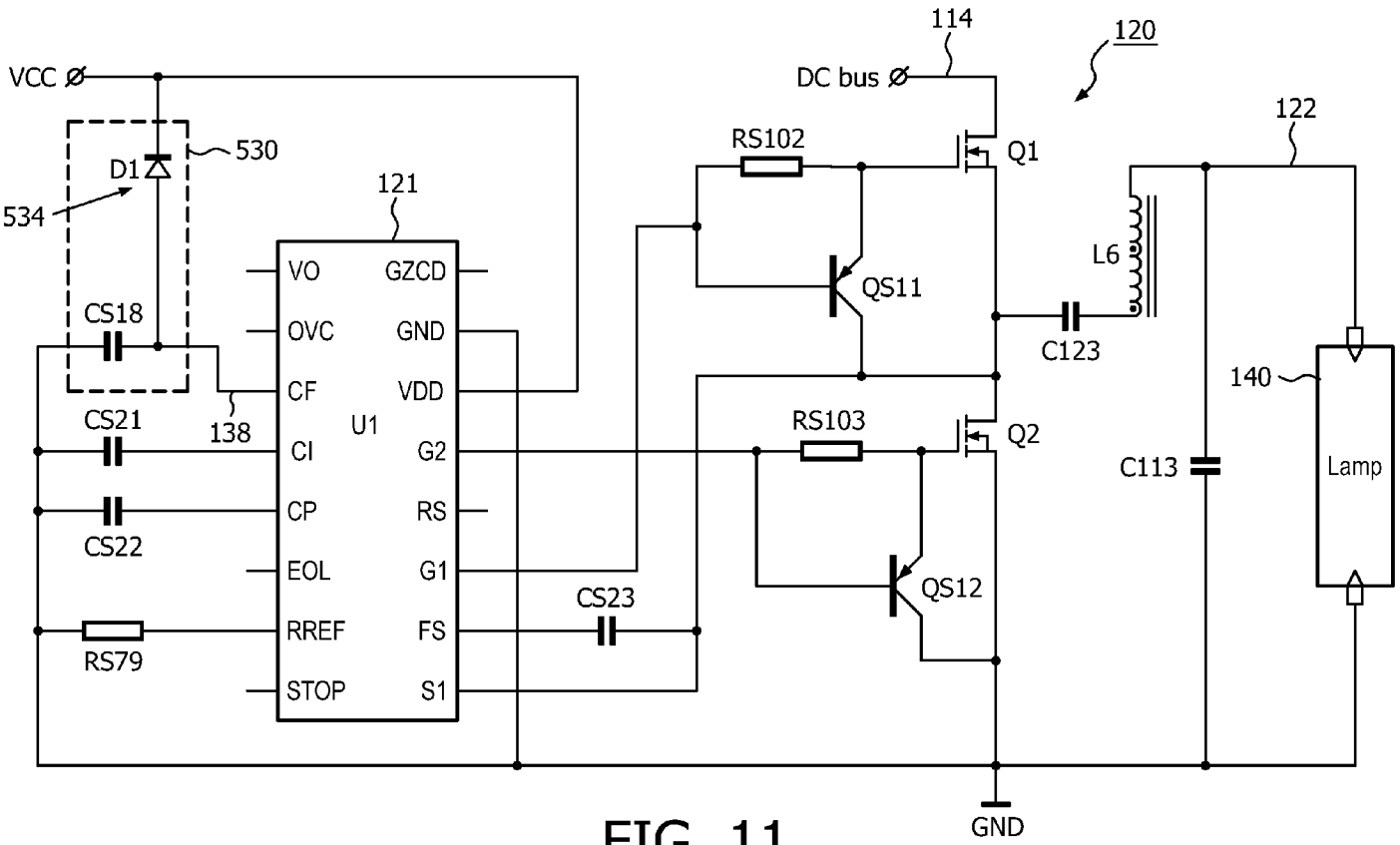
FIG. 11 is a schematic diagram of an electronic ballast in accordance with an embodiment of the present invention.

FIG. 11, in which like elements share like reference numbers with FIG. 10, is a schematic diagram of the electronic ballast. The compensator 530 includes a temperature compensating diode as the temperature sensing device.

The compensator 530 in this example includes a diode D1 and a capacitor CS18 connected in series between a fixed voltage and ground. The output adjust signal is present between the diode D1 and the capacitor CS18, and is provided to the controller 121.

The DC/AC converter 120 is a controller driven converter that includes a controller 121 responsive to the output adjust signal 138 and operably connected to switch MOSFETs Q1, Q2, which provide voltage to inductor L6. This provides AC power 122 at an AC output frequency to the lamp 140. The voltage across capacitor CS18 connected to pin CF of the controller 121 determines the switching frequency and the AC output frequency.

Diode D1 connected between a fixed voltage and pin CF of the controller 121 is a temperature compensating diode. When the electronic ballast temperature is normal, the diode D1 does not conduct and has no effect on the switching frequency. When the electronic ballast temperature is greater than a threshold electronic ballast temperature, such as 100 degrees Celsius, the reverse leakage current through the diode D1 increases rapidly with temperature, increasing the voltage on pin CF of the controller 121. This increases the switching frequency and the AC output frequency, which decreases the output power to the lamp 140 and the input power to the electronic ballast, reducing electronic ballast temperature.

Figure 12:
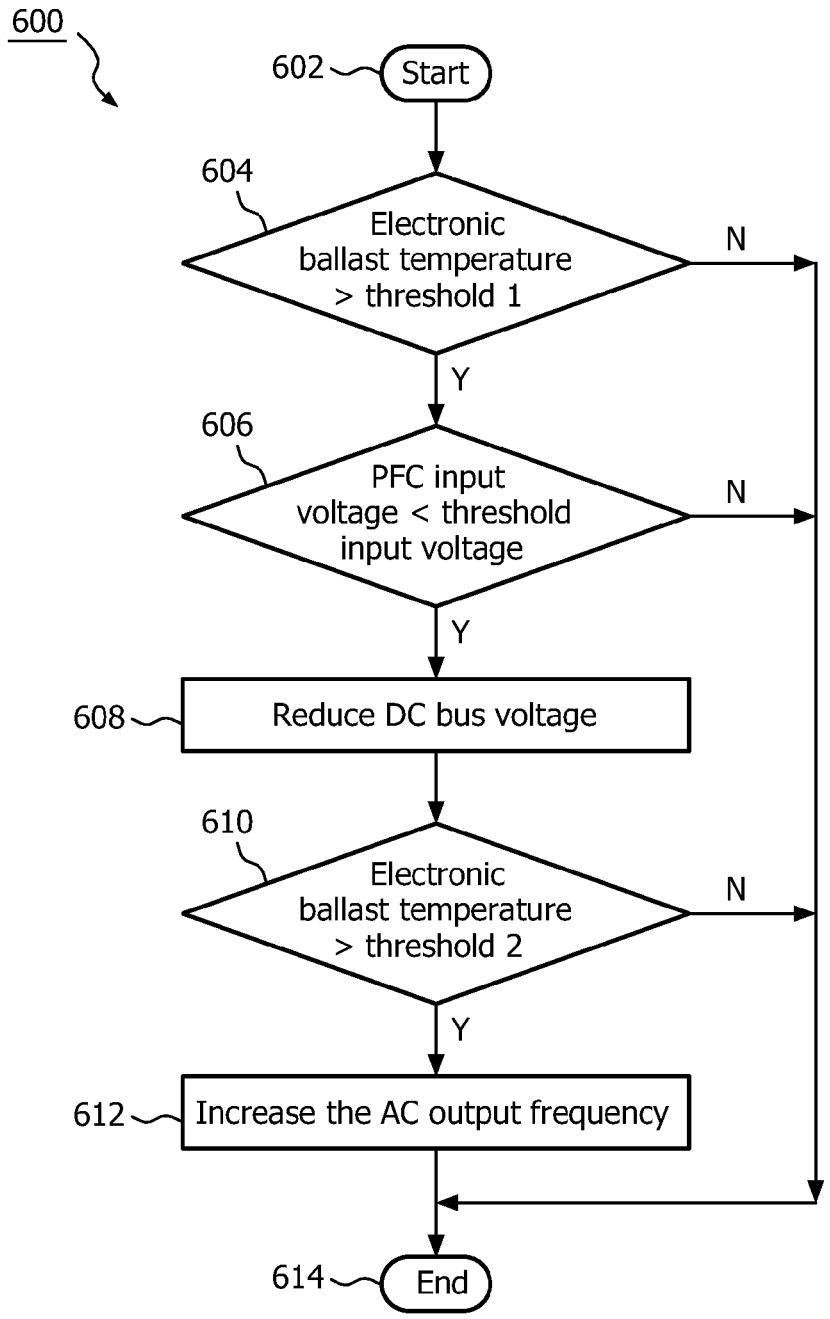
FIG. 12 is a flowchart of a method of power thermal cutback for an electronic ballast in accordance with an embodiment of the present invention.

FIG. 12 is a flowchart of a method of power thermal cutback for an electronic ballast in accordance with various embodiments of the present invention. The power thermal cutback method 600 starts 602 and it is determined whether the electronic ballast temperature is greater than a first threshold electronic ballast temperature 604. When the electronic ballast temperature is not greater than a first threshold electronic ballast temperature, the method ends 614. When the electronic ballast temperature is greater than a first threshold electronic ballast temperature, it is determined whether the PFC input voltage is less than a threshold PFC input voltage 606. When the PFC input voltage is not less than a threshold PFC input voltage, the method ends 614. When the PFC input voltage is less than a threshold PFC input voltage, the DC bus voltage is reduced 608. In one embodiment, the amount of reduction in the DC bus voltage is based on the PFC input voltage.

After the DC bus voltage is reduced, it is determined whether the electronic ballast temperature is greater than a second threshold electronic ballast temperature 610. When the electronic ballast temperature is not greater than a second threshold electronic ballast temperature, the method ends 614. When the electronic ballast temperature is greater than a second threshold electronic ballast temperature, the AC output frequency is increased 612. In one embodiment, the first threshold electronic ballast temperature and the second threshold electronic ballast temperature are about equal.

Those skilled in that art will appreciate that one or more steps of the method 600 can be performed independently and/or performed in different orders as desired for a particular application. For example, the determination 604 and DC bus voltage reduction 608 can be performed independently; the determination 606 and DC bus voltage reduction 608 can be performed independently; or the determination 610 and AC output frequency increase 612 performed independently. In another example, the determination 606 can be performed before the determination 604. In another example, the determination 604 can be omitted and the DC bus voltage reduction 608 made immediately after the determination 604.

While several inventive embodiments have been described and illustrated herein, those of ordinary skill in the art will readily envision a variety of other means and/or structures for performing the function and/or obtaining the results and/or one or more of the advantages described herein, and each of such variations and/or modifications is deemed to be within the scope of the inventive embodiments described herein. More generally, those skilled in the art will readily appreciate that all parameters, dimensions, materials, and configurations described herein are meant to be exemplary and that the actual parameters, dimensions, materials, and/or configurations will depend upon the specific application or applications for which the inventive teachings is/are used. Those skilled in the art will recognize, or be able to ascertain using no more than routine experimentation, many equivalents to the specific inventive embodiments described herein. It is, therefore, to be understood that the foregoing embodiments are presented by way of example only and that, within the scope of the appended claims and equivalents thereto, inventive embodiments may be practiced otherwise than as specifically described and claimed. Inventive embodiments of the present disclosure are directed to each individual feature, system, article, material, kit, and/or method described herein. In addition, any combination of two or more such features, systems, articles, materials, kits, and/or methods, if such features, systems, articles, materials, kits, and/or methods are not mutually inconsistent, is included within the inventive scope of the present disclosure.

It should also be understood that, unless clearly indicated to the contrary, in any methods claimed herein that include more than one step or act, the order of the steps or acts of the method is not necessarily limited to the order in which the steps or acts of the method are recited. Also, any reference numerals or other characters, appearing between parentheses in the claims, are provided merely for convenience and are not intended to limit the claims in any way.

The invention claimed is:

1. An electronic ballast operably connected to provide power to a lamp, the electronic ballast comprising:

a PFC converter configured to receive a PFC input voltage and to provide a DC bus voltage at a DC bus;

a DC/AC converter configured to receive the DC bus voltage from the DC bus and to provide AC power to the lamp at an AC output frequency; and a compensator comprising a Zener diode, a voltage divider having a first resistor and a second resistor, and a transistor circuit having a transistor operably connected in series with a negative temperature coefficient thermal resistor, the transistor having an emitter operably connected to the negative temperature coefficient thermal resistor and a base operably connected between the first resistor and the second resistor, wherein the Zener diode, the voltage divider, and the transistor circuit are operably connected in parallel between the DC bus and a common, and wherein the compensator is responsive to an electronic ballast condition parameter, the compensator configured to provide a compensator signal to the PFC converter or the DC/AC converter, wherein the PFC converter or the DC/AC converter responds to the compensator signal to reduce the power to the lamp as a result of the electronic ballast condition parameter passing an electronic ballast condition parameter threshold, and wherein the electronic ballast condition parameter is an electronic ballast temperature, the compensator signal is a DC bus adjust signal, and the PFC converter responds to the DC bus adjust signal by reducing the DC bus voltage as a result of the electronic ballast temperature satisfying a threshold electronic ballast temperature.

2. The electronic ballast of claim 1, wherein the DC/AC converter is responsive to the output adjust signal to increase the AC output frequency when the electronic ballast temperature is greater than the threshold electronic ballast temperature.

3. The electronic ballast of claim 2, wherein the compensator comprises a diode and a capacitor connected in series between a fixed voltage and ground, and the output adjust signal is provided between the diode and the capacitor.

4. The electronic ballast of claim 1, wherein the compensator is a microcontroller.

5. The electronic ballast of claim 1, wherein the electronic ballast condition parameter is sensed with the negative temperature coefficient thermal resistor.

6. The electronic ballast of claim 1, wherein the compensator is a microcontroller.

7. The electronic ballast of claim 1, wherein the PFC converter includes a boost converter.

8. The electronic ballast of claim 1, wherein the electronic ballast includes an electromagnetic interference filter that is operatively coupled to the PFC converter.

9. The electronic ballast of claim 8, wherein the electronic ballast further includes a full wave rectifier that is connected between the PFC converter and the electromagnetic interference filter.

10. The electronic ballast of claim 1, further comprising: a PFC controller comprising a feedback input.

11. A method, comprising:

causing a PFC converter of an electronic ballast to receive a PFC input voltage and to provide a DC bus voltage at a DC bus;

causing a DC/AC converter of the electronic ballast to receive the DC bus voltage and to provide AC power to a lamp at an AC output frequency;

causing a compensator to provide a compensator signal to the PFC converter or the DC/AC converter, wherein the compensator is responsive to an electronic ballast condition parameter and the compensator comprises:

a Zener diode, a voltage divider having a first resistor and a second resistor, and a transistor circuit having a transistor operably connected in series with a negative temperature coefficient thermal resistor, the transistor having an emitter operably connected to the negative temperature coefficient thermal resistor and a base operably connected between the first resistor and the second resistor, wherein the Zener diode, the voltage divider, and the transistor circuit are operably connected in parallel between the DC bus and a common; and when the electronic ballast condition parameter satisfies an electronic ballast condition parameter threshold:

causing the PFC converter or the DC/AC converter to respond to the compensator signal to reduce a power output of the electronic ballast, wherein the electronic ballast condition parameter is an electronic ballast temperature, the compensator signal is a DC bus adjust signal, and the PFC converter responds to the DC bus adjust signal by reducing the DC bus voltage as a result of the electronic ballast temperature satisfying the electronic ballast condition parameter threshold.

12. The method of claim 11, wherein the electronic ballast temperature is sensed at the negative temperature coefficient thermal resistor.

13. The method of claim 11, wherein the compensator is a microcontroller.

14. The method of claim 11, wherein the PFC converter includes a boost converter.

15. The method of claim 11, wherein the electronic ballast includes an electromagnetic interference filter that is operatively coupled to the PFC converter.

16. The method of claim 15, wherein the electronic ballast further includes a full wave rectifier that is connected between the PFC converter and the electromagnetic interference filter.

17. The method of claim 11, wherein the electronic ballast further includes a PFC controller comprising a feedback input.

18. An electronic ballast for providing power to a lamp, the electronic ballast comprising:

a PFC converter configured to receive a PFC input voltage and to provide a DC bus voltage at a DC bus;

a DC/AC converter configured to receive the DC bus voltage from the DC bus and to provide AC power to the lamp at an AC output frequency; and a compensator responsive to an electronic ballast condition parameter, the compensator being configured to provide a compensator signal to at least one of the PFC converter and the DC/AC converter, the compensator comprising a Zener diode circuit having a Zener diode and a transistor connected in series, and a resistor circuit having a negative temperature compensation resistor, wherein the at least one of the PFC converter and the DC/AC converter responds to the compensator signal to reduce the power to the lamp when the electronic ballast condition parameter passes an electronic ballast condition parameter threshold, wherein the electronic ballast condition parameter is an electronic ballast temperature, the compensator signal is a DC bus adjust signal, and the PFC converter is responsive to the DC bus adjust signal to reduce the DC bus voltage when the electronic ballast temperature is greater than a threshold electronic ballast temperature, and wherein:

the transistor of the Zener diode circuit has a base operably connected to the negative temperature compensation resistor; and the Zener diode circuit and the resistor circuit are connected in parallel between a fixed voltage and common.

19. The electronic ballast of claim 18, further comprising:

an electromagnetic interference filter that is operatively coupled to the PFC converter.

20. The electronic ballast of claim 19, further comprising:

a full wave rectifier that is connected between the PFC converter and the electromagnetic interference filter.

* * * * *